US011849894B2

(12) United States Patent
Krebs

(10) Patent No.: US 11,849,894 B2
(45) Date of Patent: Dec. 26, 2023

(54) CLEANING APPARATUS WITH FLUID DIVERTER

(71) Applicant: BISSELL Inc., Grand Rapids, MI (US)

(72) Inventor: Alan J. Krebs, Pierson, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 17/873,448

(22) Filed: Jul. 26, 2022

(65) Prior Publication Data

US 2022/0354333 A1 Nov. 10, 2022

Related U.S. Application Data

(63) Continuation of application No. 16/494,403, filed as application No. PCT/US2018/022626 on Mar. 15, 2018, now Pat. No. 11,432,699.

(60) Provisional application No. 62/472,235, filed on Mar. 16, 2017.

(51) Int. Cl.

| | |
|---|---|
| ***A47L 11/40*** | (2006.01) |
| ***A47L 11/28*** | (2006.01) |
| ***A47L 13/22*** | (2006.01) |
| ***A47L 9/28*** | (2006.01) |
| *A47L 13/17* | (2006.01) |

(52) U.S. Cl.

CPC ..... *A47L 11/4086* (2013.01); *A47L 11/28* (2013.01); *A47L 11/4011* (2013.01); *A47L 11/4075* (2013.01); *A47L 13/225* (2013.01); *A47L 9/2805* (2013.01); *A47L 9/2847* (2013.01); *A47L 13/17* (2013.01); *A47L 2601/04* (2013.01)

(58) Field of Classification Search

CPC .. A47L 11/4086; A47L 11/28; A47L 11/4011; A47L 11/4075; A47L 13/225; A47L 9/2805; A47L 9/2847; A47L 13/17; A47L 2601/04; A47L 11/34; A47L 11/4008; A47L 13/22

See application file for complete search history.

(56) References Cited

U.S. PATENT DOCUMENTS

| | | | | |
|---|---|---|---|---|
| 7,650,667 | B2 | 1/2010 | Rosenzweig et al. | |
| 7,891,047 | B2 | 2/2011 | Milanese | |
| 8,607,404 | B2 | 12/2013 | Krebs | |
| 2008/0189900 | A1 | 8/2008 | Milanese | |
| 2014/0259515 | A1 | 9/2014 | Nutall et al. | |
| 2016/0120388 | A1 | 5/2016 | Liu et al. | |
| 2016/0150938 | A1* | 6/2016 | Grove | A47L 11/4086 15/4 |
| 2016/0360943 | A1 | 12/2016 | Krebs et al. | |
| 2018/0168416 | A1* | 6/2018 | Miller | A47L 11/4025 |

FOREIGN PATENT DOCUMENTS

| | | | |
|---|---|---|---|
| CN | 203953562 | U | 11/2014 |
| CN | 204351758 | U | 5/2015 |
| CN | 204961918 | U | 1/2016 |

(Continued)

*Primary Examiner* — David Redding

(74) *Attorney, Agent, or Firm* — Warner Norcross + Judd LLP

(57) ABSTRACT

A cleaning apparatus includes a cleaning head, a supply tank, and an outlet in fluid communication with the supply tank. A diverter is provided in a distribution path between the supply tank and the outlet and is configured to divert cleaning fluid away from the outlet based on detected movement or acceleration of the apparatus.

20 Claims, 5 Drawing Sheets

(56) References Cited

FOREIGN PATENT DOCUMENTS

| | | | | |
|---|---|---|---|---|
| CN | 105338872 | A | | 2/2016 |
| CN | 205162987 | U | | 4/2016 |
| CN | 105796025 | A | | 7/2016 |
| CN | 105877623 | A | | 8/2016 |
| EP | 2117404 | B1 | | 7/2012 |
| KR | 100710040 | B1 | | 4/2007 |
| KR | 20080045365 | A | | 5/2008 |
| WO | WO2014085444 | | * | 6/2014 |
| WO | 2016025239 | A1 | | 2/2016 |
| WO | 2016191624 | A1 | | 12/2016 |

* cited by examiner

CLEANING APPARATUS WITH FLUID DIVERTER

CROSS REFERENCE TO RELATED APPLICATION(S)

This application is a continuation of U.S. patent application Ser. No. 16/494,403, filed Sep. 19, 2019, which is a National Stage Entry of International Application No. PCT/US2018/022626, filed Mar. 15, 2018, which claims the benefit of U.S. Provisional Patent Application No. 62/472,235, filed Mar. 16, 2017, all of which are incorporated herein by reference in their entirety.

BACKGROUND

Steam cleaning apparatuses, such as steam mops and hand-held steamers are configured for cleaning a wide variety of common household surfaces such as bare flooring, including tile, hardwood, laminate, vinyl, and linoleum, as well as carpets, rugs, countertops, stove tops and the like. Typically, steam mops have at least one liquid tank or reservoir for storing a liquid, generally water, which is fluidly connected to a steam generator via a flow control mechanism, such as a pump or valve. The steam generator includes a heater for heating the liquid to produce steam, which can be directed towards the surface to be cleaned through a steam outlet, typically located in a foot or cleaning head that engages the surface to be cleaned during use. The steam is typically applied to the backside of a cleaning pad that is attached to the cleaning head. The steam saturates the cleaning pad, and the damp cleaning pad is wiped across the surface to be cleaned to remove dirt, debris, and other soils present on the surface.

BRIEF DESCRIPTION

A cleaning apparatus includes a cleaning head, a supply tank, an outlet in fluid communication with the supply tank and positioned to distribute cleaning fluid to a floor surface, a distribution path between the supply tank and the outlet, and a diverter in the distribution path and configured to divert cleaning fluid away from the outlet when the cleaning head is stationary and to deliver steam to the steam outlet when the cleaning head is moving.

The cleaning apparatus can comprise an accelerometer configured to detect acceleration of the apparatus to determine if the apparatus is moving, and the diverter can be configured to divert cleaning fluid away from the outlet when no acceleration of the apparatus is detected by the accelerometer, and to deliver cleaning fluid to the outlet when acceleration of the apparatus is detected by the accelerometer.

BRIEF DESCRIPTION OF THE DRAWING(S)

DETAILED DESCRIPTION

Figure 1:
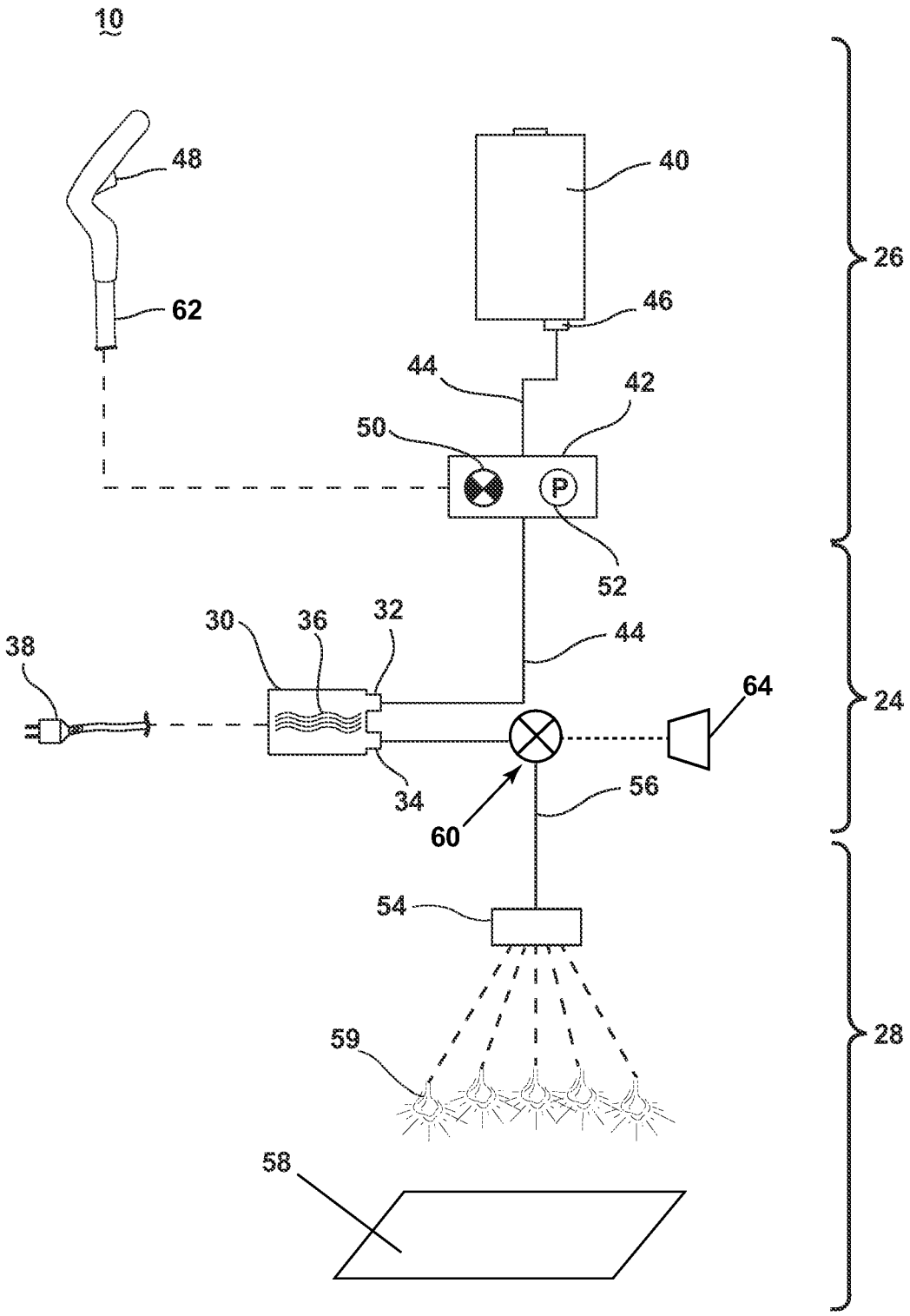
FIG. 1 is a schematic view of a steam cleaning apparatus.

FIG. 1 is a schematic view of various functional systems of a steam cleaning apparatus in the form of a steam mop 10. While referred to herein as a steam mop 10, the steam cleaning apparatus can alternatively be configured as a hand-held steam applicator device, or as an apparatus having a hand-held accessory tool connected to a canister or other portable device by a steam distribution hose. Additionally, the steam cleaning apparatus can be configured to have agitation capability, including scrubbing and/or sweeping, vacuuming capability, and/or extraction capability.

The steam mop 10 includes a steam generation system 24 for producing steam from liquid, a liquid distribution system 26 for storing liquid and delivering the liquid to the steam generation system 24, and a steam delivery system 28 for delivering steam to a surface to be cleaned.

The steam generation system 24 can include a steam generator 30 producing steam from liquid and is configured to heat liquid to at least 100° C. to generate steam. The steam generator 30 can include an inlet 32 and an outlet 34, and a heater 36 between the inlet 32 and outlet 34 for boiling the liquid. Some non-limiting examples of steam generators 30 include, but are not limited to, a flash heater, a boiler, an immersion heater, and a flow-through steam generator. The steam generator 30 can be electrically coupled to a power source 38, such as a battery or by a power cord plugged into a household electrical outlet.

The liquid distribution system 26 can include a supply of liquid or liquid source, such as at least one supply tank 40 adapted to hold or store a quantity of liquid. The liquid can comprise one or more of any suitable cleaning liquids, including, but not limited to, water, compositions, concentrated detergent, diluted detergent, etc., and mixtures thereof. For example, the liquid can comprise a mixture of water and concentrated detergent. The liquid distribution system 26 can further include multiple supply tanks, such as one tank containing water and another tank containing a cleaning agent.

The steam generator 30 is in fluid communication with the supply tank 40. The liquid distribution system 26 can further comprise a flow controller 42 for controlling the flow of liquid through a fluid conduit 44 coupled between an outlet port 46 of the supply tank 40 and the inlet 32 of the steam generator 30. An actuator 48 can be provided to actuate the flow controller 42 and dispense liquid to the steam generator 30.

In one configuration, the liquid distribution system 26 can comprise a gravity-feed system and the flow controller 42 can comprise a valve 50, whereby when valve 50 is open, liquid will flow under the force of gravity, through the fluid conduit 44, to the steam generator 30. The actuator 48 can be operably coupled to the valve 50 such that pressing the actuator 48 will open the valve 50. The valve 50 can be mechanically actuated, such as by providing a push rod with one end coupled to the actuator 48 and another end in register with the valve 50, such that pressing the actuator 48 forces the push rod to open the valve 50. Alternatively, the valve 50 can be electrically actuated, such as by providing an electrical switch between the valve 50 and the power source 38 that is selectively closed when the actuator 48 is actuated, thereby powering the valve 50 to move to an open position.

In another configuration, the flow controller 42 can comprise a pump 52 which distributes liquid from the supply tank 40 to the steam generator 30. The actuator 48 can be operably coupled to the pump 52 such that pressing the actuator 48 will activate the pump 52. The pump 52 can be electrically actuated, such as by providing an electrical switch between the pump 52 and the power source 38 that is selectively closed when the actuator 48 is actuated, thereby activating the pump 52.

The steam delivery system 28 can include at least one steam outlet 54 in fluid communication with the steam generator 30 for delivering steam to the surface to be cleaned, and a steam distribution path 56 can extend between the steam generator 30 and the at least one steam outlet 54 to deliver steam from the steam generator 30 to the at least one steam outlet 54. The at least one steam outlet 54 can comprise any structure, such as a perforated manifold or at least one nozzle; multiple steam outlets can also be provided. In further examples discussed herein, the at least one steam outlet 54 can comprise a steam distribution nozzle.

The steam distribution path 56 can, for example comprise a fluid conduit coupled between the outlet 34 of the steam generator 30 and the at least one steam outlet 54; the fluid conduit can comprise one or more flexible or rigid conduit sections fluidly coupling the outlet 34 of the steam generator 30 and the at least one steam outlet 54. Optionally, a portion of the steam distribution path 56 can extend through a coupling or swivel joint of the steam mop 10.

In use, the generated steam is pushed out of the outlet 34 of the steam generator 30 by pressure generated within the steam generator 30 and, optionally, by pressure generated by the pump 52. The steam flows through the steam distribution path 56, and out of the at least one steam outlet 54, as indicated at 59.

A cleaning pad 58 can be removably attached over the steam outlet 54 to the steam mop 10. In use, the cleaning pad 58 is saturated by the steam from the steam outlet 54, and the damp cleaning pad 58 is wiped across the surface to be cleaned to remove dirt present on the surface. The cleaning pad 58 can be provided with features that enhance the scrubbing action on the surface to be cleaned to help loosen dirt on the surface. The cleaning pad 58 can be disposable or reusable, and can further be provided with a cleaning agent or composition that is delivered to the surface to be cleaned along with the steam. For example, the cleaning pad 58 can comprise disposable sheets that are pre-moistened with a cleaning agent. The cleaning agent can be configured to interact with the steam, such as having at least one component that is activated or deactivated by the temperature and/or moisture of the steam. In one example, the temperature and/or moisture of the steam can act to release the cleaning agent from the cleaning pad 58.

The steam mop 10 can further be provided with a diverter 60 configured to divert steam away from the surface to be cleaned when a handle 62 of the steam mop 10 is in an upright stored or parked position. The diverter 60 can be provided in the steam distribution path 56 between an outlet 34 of the steam generator 30 and the at least one steam outlet 54. In particular, the diverter 60 can be configured to divert steam away from the at least one steam outlet 54 when the handle 62 is in the upright, parked position and to deliver steam to the at least one steam outlet 54 when the handle 62 is in an in-use or reclined use position.

Diverting the steam away from the floor when the handle 62 is parked can prevent inadvertent floor damage. When the handle 62 is moved to the reclined use position, the diverter 60 can direct steam to the steam outlet 54.

Optionally, a steam exhaust port 64, which is directed away from the surface to be cleaned, can be fluidly coupled with the diverter 60 for exhausting steam when the handle 62 is parked. The steam exhaust port 64 can comprise any structure, such as a perforated grill or at least one nozzle; multiple exhaust ports can also be provided. In further examples discussed herein, the steam exhaust port 64 can comprise a steam diversion nozzle.

In a further example, the diverter 60 can be further configured to divert steam away from the at least one steam outlet 54 when the steam mop 10 is stationary, i.e. not moving over the surface to be cleaned, and to deliver steam to the at least one steam outlet 54 when the steam mop 10 is moving. Diverting the steam away from the floor when the handle 62 is reclined but the steam mop 10 is not moving can prevent inadvertent floor damage. When the steam mop 10 resumes movement, the diverter 60 can direct steam to the steam outlet 54.

The steam mop 10 shown in FIG. 1 can be used to effectively remove dirt (which may include dust, stains, and other debris) from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the present disclosure.

The cleaning pad 58 is attached to the steam mop 10, over the steam outlet 54, the supply tank 40 is filled with liquid, and the steam generator 30 is coupled to the power source 38. Upon actuation of the actuator 48, liquid flows to the steam generator 30 and is heated to its boiling point to produce steam. The steam 59 exits the steam outlet 54 and passes through the cleaning pad 58. As steam 59 passes through the cleaning pad 58, a portion of the steam 59 may return to liquid form before reaching the floor surface. The steam 59 delivered to the floor surface also returns to liquid form. As the damp cleaning pad 58 is wiped over the surface to be cleaned, excess liquid and dirt on the surface is absorbed by the cleaning pad 58.

Figure 2:
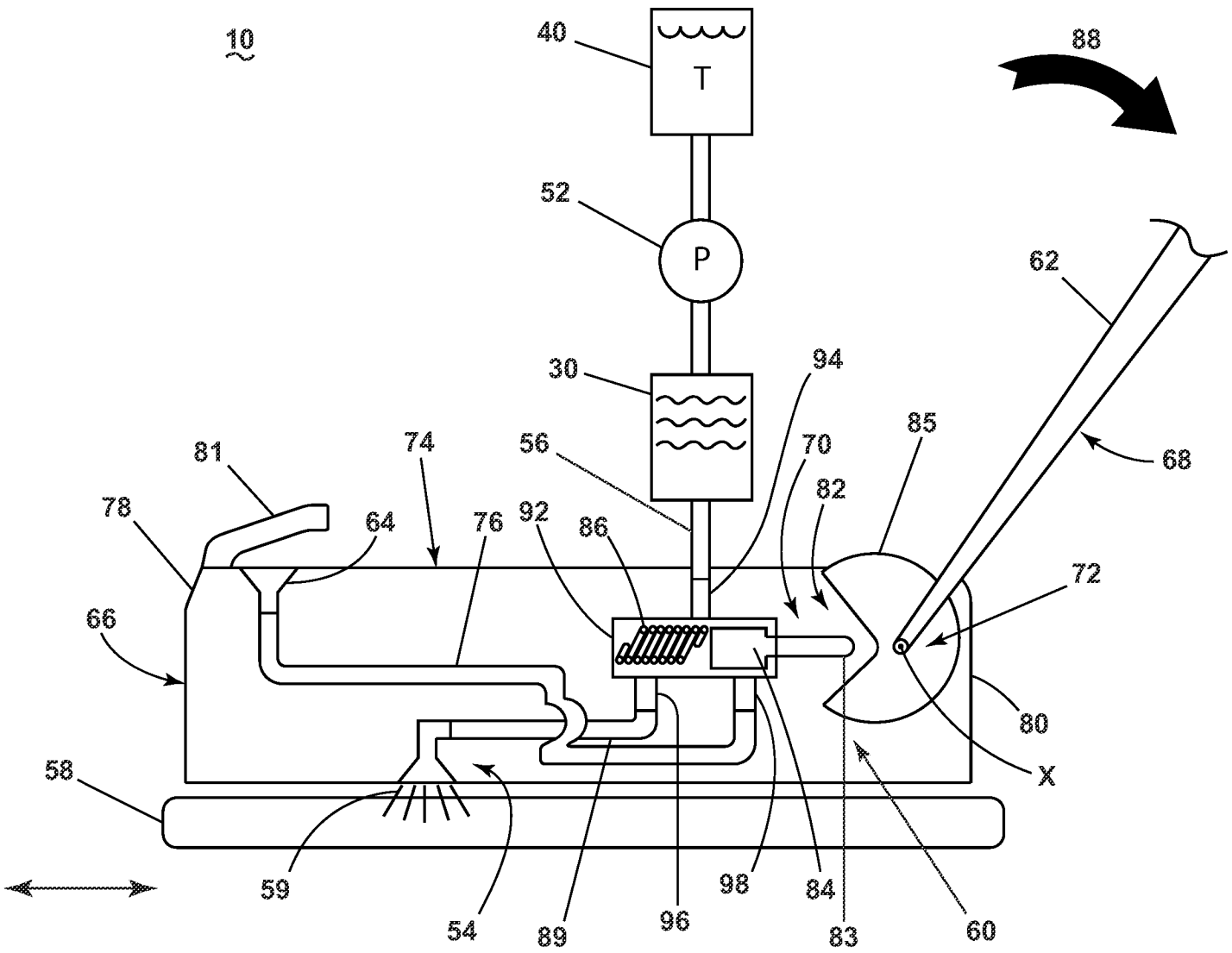
FIG. 2 is a schematic view of a steam cleaning apparatus in the form of a steam mop and showing a diverter in a first position for delivering steam to a floor surface.

FIG. 2 is a schematic view of a steam cleaning apparatus in the form of a steam mop 10 according to a first example of the present disclosure. For purposes of description related to the figures, the terms "upper," "lower," "right," "left," "rear," "front," "vertical," "horizontal," "inner," "outer," and derivatives thereof shall relate to the present disclosure as oriented in FIG. 2 from the perspective of a user behind the steam mop 10, which defines the rear of the steam mop 10. However, it is to be understood that the present disclosure may assume various alternative orientations, except where expressly specified to the contrary. It is also to be understood that the specific devices and processes illustrated in the attached drawings, and described in the following specification are simply exemplary examples of the inventive concepts defined in the appended claims. Hence, specific dimensions and other physical characteristics relating to the examples disclosed herein are not to be considered as limiting, unless the claims expressly state otherwise.

The steam mop 10 comprises a base or cleaning head 66 which is adapted to be moved across a surface to be cleaned. An upright assembly 68 can be pivotally coupled with the cleaning head 66 for movement about at least one axis, or about multiple axes. The cleaning head 66 and upright assembly 68 may each support one or more components of the various functional systems discussed with respect to FIG. 1.

In the illustrated example, the upright assembly 68 comprises an elongated handle 62 operably coupled with the cleaning head 66; in one example, the handle 62 can extend from the cleaning head 66, with a grip (not shown) provided on an end of the handle 62 to facilitate movement of the steam mop 10 by a user. The handle 62 is movable between at least an upright parked position and a reclined use position. In the upright parked position the handle 62 can be oriented substantially orthogonally or vertically relative to the surface to be cleaned, and in the reclined use position the handle 62 is pivoted rearwardly relative to the cleaning head 66 to form an acute angle with the surface to be cleaned.

A coupling joint 72 is formed at an opposite end of the handle 62 and moveably mounts the handle 62 with the cleaning head 66. The coupling joint 72 can be configured for the handle 62 to pivot or rotate about a single axis X as shown herein, wherein the axis X is generally parallel to the surface to be cleaned on which the cleaning head 66 moves, and is further generally traverse the direction of travel of the cleaning head 66 during normal operation. The coupling joint 72 can alternatively comprise a universal joint, such that the handle 62 can pivot about at least two axes relative to the cleaning head 66. Optionally, a portion of the steam distribution path 56 can extend through the coupling joint 72.

While some of the functional systems and their components, such as the steam generation system 24, the liquid distribution system 26, and the steam delivery system 28 of FIG. 1, are shown schematically in FIG. 2, these functional systems and components may be supported by the cleaning head 66 or the upright assembly 68. For example, the supply tank 40, pump 52, and steam generator 30 can be supported by the upright assembly 68 such that the supply tank 40, pump 52, and steam generator 30 are supported or carried by or otherwise coupled with the handle 62. In another example, the supply tank 40, pump 52, and steam generator 30 can be supported or carried by the cleaning head 66.

In the case where the upright assembly 68 supports functional systems such as the steam generation system 24, the liquid distribution system 26, the steam delivery system 28, or any of their components, the upright assembly 68 can include a housing to impart support and accommodate the systems and components. The housing can pivotably couple with the cleaning head 66, while the handle 62 can operatively couple with the housing. For example, the supply tank 40, pump 52, and steam generator 30 can be located within the housing and movable with the upright assembly 68 relative to the cleaning head 66.

The diverter 60 in the present example comprises a diverter valve 70 configured to control the flow of steam through the steam distribution path 56. The diverter valve 70 can be movable between a position where the steam distribution path 56 to the steam outlet 54 is open and a position where the steam distribution path 56 to the steam outlet 54 is closed.

The cleaning head 66 can comprise a base housing 74 adapted to be moved over the surface to be cleaned and which can mount the cleaning pad 58, generally described with respect to FIG. 1. The base housing 74 includes the at least one steam outlet 54 and can additionally include the diverter valve 70 within the steam distribution path 56. In the example shown in FIG. 2, the base housing 74 can include the diverter valve 70 fluidly coupled between the at least one steam outlet 54, shown in the illustrated example as comprising a steam distribution nozzle. In particular, the steam distribution nozzle 54 can be in the form of a floor nozzle 54 which is position on the cleaning head 66 to deliver steam toward the surface to be cleaned. The steam outlet 54 and steam generator 30 are not limited to a floor nozzle and a heater respectively, and can be in any suitable form to dispense and produce steam. The base housing 74 can also include the steam exhaust port 64, which can be in the form of a steam diversion nozzle, coupled to the diverter valve 70. A fluid conduit or diversion conduit 76 can extend from the diverter valve 70 to the steam exhaust port 64. The steam exhaust port 64 may be located anywhere on the base housing 74 that diverts steam away from the surface to be cleaned. While steam exhaust port 64 is shown located on an upper front portion 78 of the base housing 74, the steam exhaust port 64 may alternatively be located on another portion of the base housing 74, such as, but not limited to, the sides of the base housing 74 or a rear 80 of the base housing 74. Locating the steam exhaust port 64 on an upper front portion 78 of the base housing 74 may be desirable as the user of the steam mop 10 can easily observe that steam 59 is be diverted to the exhaust port 64. Further, while only one floor nozzle 54 and one steam exhaust port 64 is shown, multiple floor nozzles 54 and/or multiple steam exhaust ports 64 may be provided.

Optionally a steam deflector 81 can be provided adjacent to the exhaust port 64 for guiding steam 59 in a predetermined direction away from the surface to be cleaned or relative to the cleaning head 66. For example, the deflector can be provided on the cleaning head 66, such as on the base housing 74, and can create a barrier or shield for preventing steam 59 from flowing toward the surface to be cleaned. In the example shown herein, with the steam exhaust port 64 on the upper front portion 78 of the base housing 74, the deflector 81 can also be provided on the upper front portion 78 of the base housing 74 and can open toward the rear 80 of the base housing 74 in order to guide steam 59 generally rearwardly over the top of the cleaning head 66.

Figure 3:
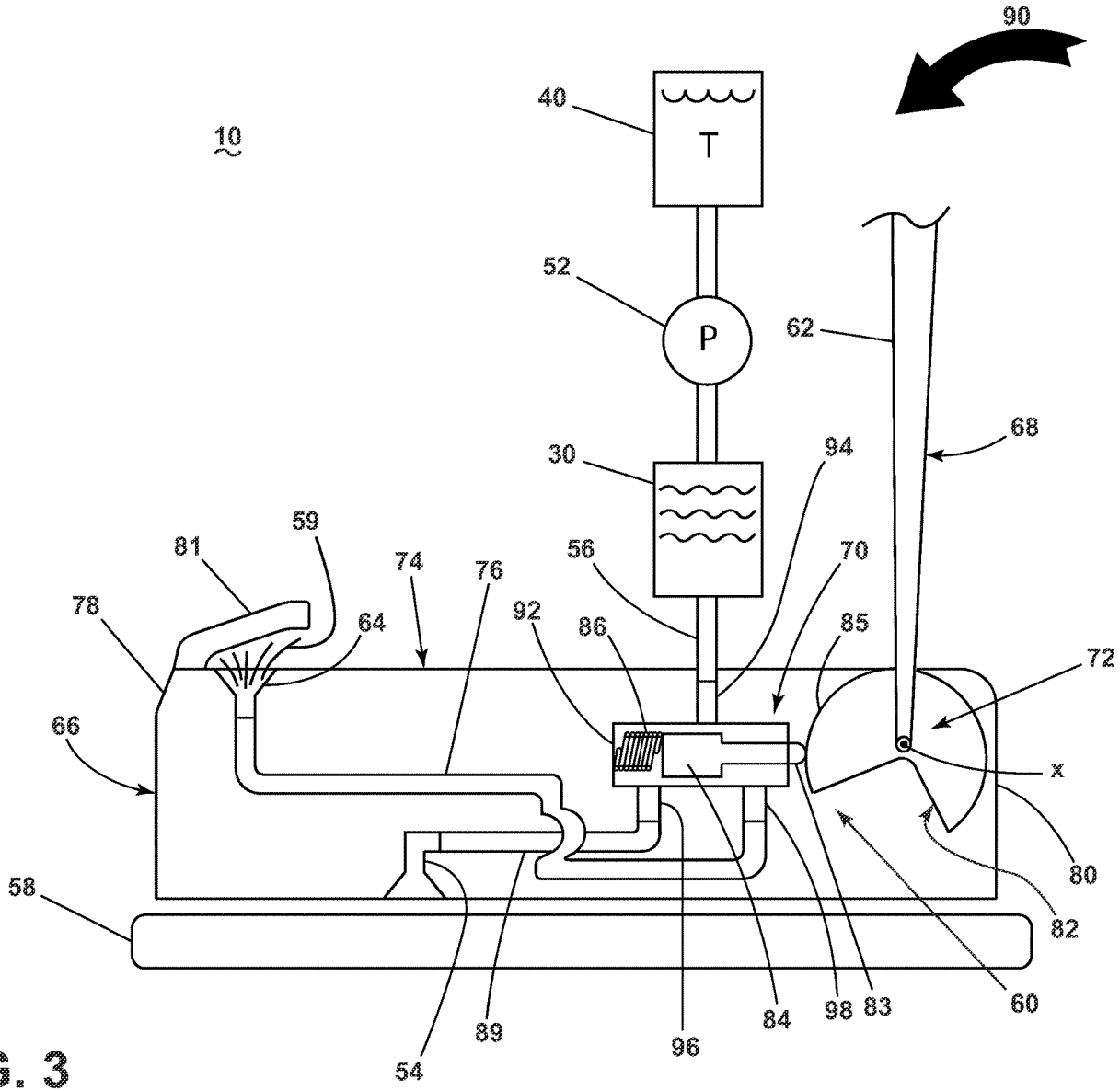
FIG. 3 is a schematic view of the steam cleaning apparatus from FIG. 2, showing the diverter in a second position for redirecting steam away from the floor surface.

The diverter valve 70 can be operably coupled with the handle 62 for movement of the diverter valve 70 as the handle 62 moves. In particular, the diverter valve 70 can be configured to move to a first position when the handle 62 is in a reclined use position, one example of which is shown in FIG. 2, and a second position when the handle 62 in in an upright stored or parked position as shown in FIG. 3. In the first position of the diverter valve 70, the steam distribution path 59 between the steam generator 30 and the floor nozzle 54 is open and steam 59 is supplied to the floor nozzle 54. In the second position of the diverter valve 70, the steam distribution path 59 between the steam generator 30 and the steam outlet 54 is closed, and steam 59 is supplied to the steam diversion nozzle 64.

The diverter valve 70 of the example shown herein includes a valve actuator 82 and a valve plunger 84 configured to selectively control steam delivery to the nozzles 54, 64 on the cleaning head 66. The valve actuator 82 can be provided to engage the valve plunger 84 to control the position of valve plunger 84.

The valve actuator 82 can be operably coupled with the handle 62 for movement of the valve actuator 82 as the handle 62 moves. For example, the valve actuator 82 can be a mechanical valve actuator 82 that is coupled to the handle 62 or otherwise integrated with the coupling joint 72. The valve actuator 82 shown herein includes a member rotatable about the axis X.

In one example, the valve actuator 82 can be a cam configured to transform rotary motion of the handle 62 into linear motion of the valve plunger 84, which can be operably coupled with a cam follower 83 in contact with the cam. The valve actuator or cam 82 can comprise a cam surface 85 that engages the cam follower 83 of the valve plunger 84 to move the valve plunger 84 linearly depending on the position of the handle 62.

The valve plunger 84 can optionally be biased by a spring 86 to the first position in which steam 59 is supplied to the floor nozzle 54, as shown in FIG. 2, i.e. so that the diverter valve 70 is normally open. Alternatively, the valve plunger 84 can be biased by spring 86 to the second position, i.e. so that the diverter valve 70 is normally closed.

While FIG. 2 illustrates the diverter valve 70 as having a mechanical valve actuator 82, it is within the scope of the present disclosure for the diverter valve 70 to be operable with any suitable mechanical or electrical valve actuator. For example, a micro-switch can be coupled to the handle 62 to selectively energize a solenoid diverter valve to control the diverter valve 70.

FIG. 2 shows the diverter valve 70 in the first position for delivering steam 59 to a floor surface. In use, a user can grip the end of the handle 62 and facilitate movement on the surface to be cleaned by pivoting the handle 62 in a downward direction, as indicated by the arrow 88, to a reclined use position, one example of which is shown in FIG. 2. When the handle 62 is reclined, the valve actuator 82 does not engage the valve plunger 84, and the diverter valve 70 is biased to the first position. In the first position, the steam generator 30 is fluidly coupled with the floor nozzle 54 via a fluid conduit or steam conduit 89 forming a portion of the steam distribution path 56, and the valve plunger 84 closes the pathway to the diversion nozzle 64.

FIG. 3 shows the diverter valve 70 in the second position for redirecting steam 59 away from the floor surface. When a user desires to park the steam mop 10, a user can pivot the handle 62 in an upwards direction, as indicated by the arrow 90, to the upright stored or parked position. As the handle 62 pivots upwards, the valve actuator 82 engages the valve plunger 84 and moves the diverter valve 70 to the second position. In the second position, the steam generator 30 is fluidly coupled with the diversion nozzle 64 via the diversion conduit 76, and the valve plunger 84 closes the pathway to the floor nozzle 54.

In one example, the diverter valve 70 can include a valve housing 92 having an inlet 94 in fluid communication with the steam generator 30, a first outlet 96 in fluid communication with the floor nozzle 54 via the steam conduit 89, and a second outlet 98 in fluid communication with the diversion nozzle 64 via the diversion conduit 76. The valve plunger 84 is moveable to close one of the outlets 96, 98 and can include at least a portion received within the valve housing 92 to close one of the outlets 96, 98 by selectively sealing or blocking one of the outlets 96, 98. For example, in the first position for delivering steam 59 to a floor surface, the valve plunger 84 seals or blocks the second outlet 98 such that no steam is delivered to the diversion nozzle 64 and all steam is delivered to the floor nozzle 54. In the second position for redirecting steam 59 away from the floor surface, the valve plunger 84 seals or blocks the first outlet 96 such that no steam is delivered to the floor nozzle 54 and all steam is delivered to the diversion nozzle 64. It is further within the scope of the present disclosure for the valve plunger 84 to have at least one intermediate position between the first and second positions in which the outlets 96, 98 are partially blocked, which can be used to control the amount of steam 59 delivered to the surface to be cleaned via the floor nozzle 54 for lighter steam cleaning.

Figure 4:
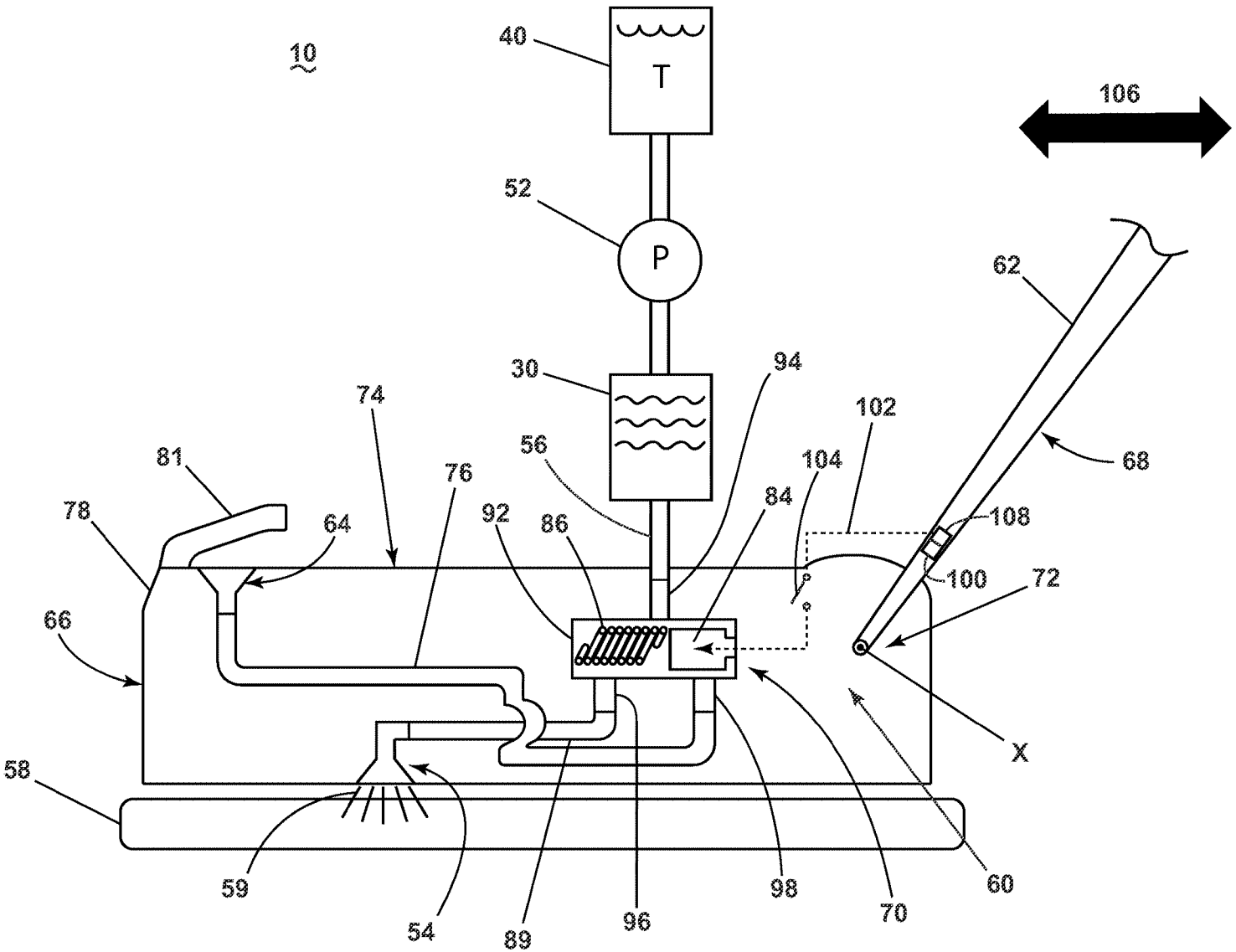
FIG. 4 is a schematic view of a steam cleaning apparatus in the form of a steam mop according to another aspect as described herein and showing a diverter in a first position for delivering steam to a floor surface.
Figure 5:
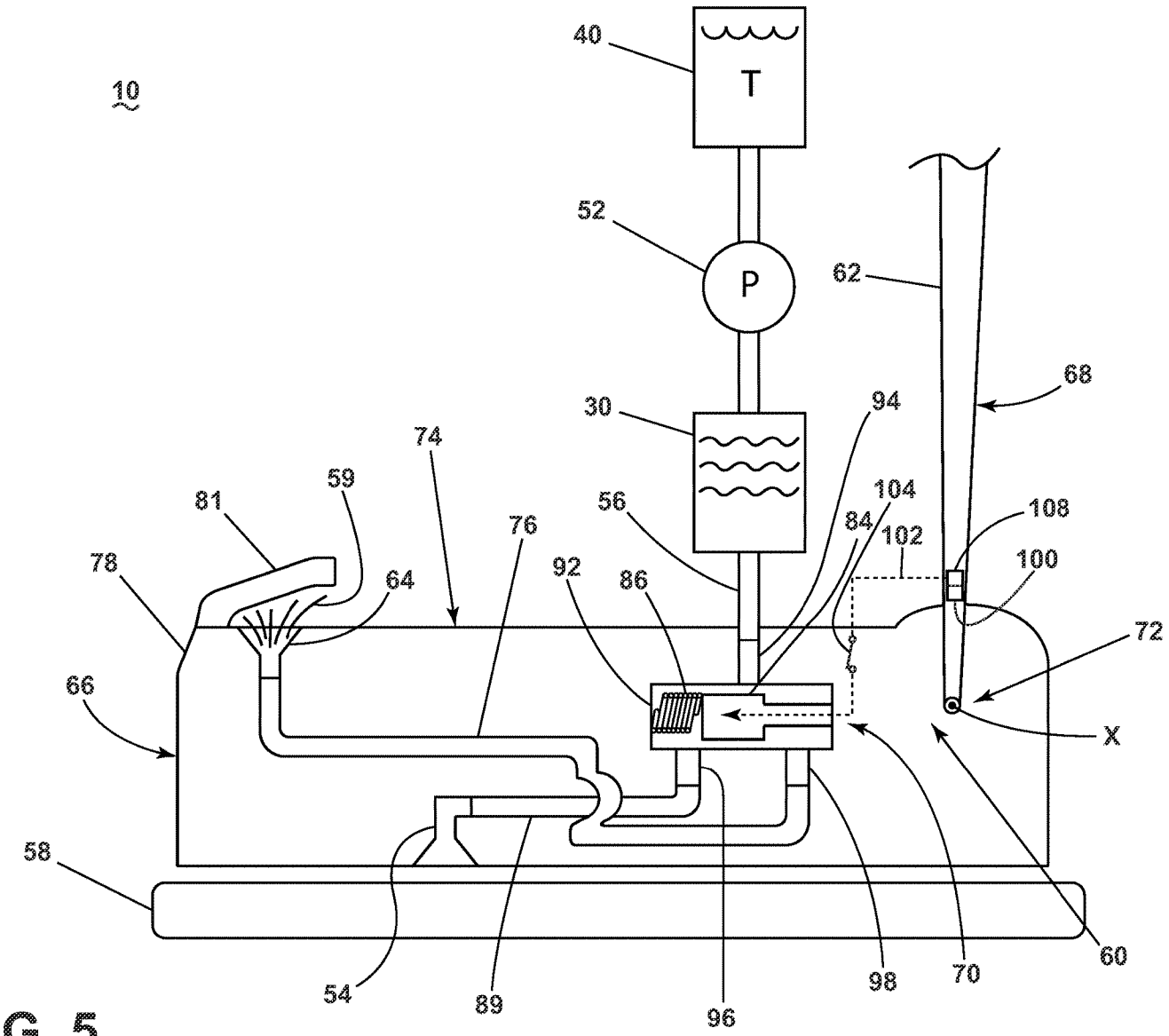
FIG. 5 is a schematic view of the steam cleaning apparatus from FIG. 4, showing the diverter in a second position for redirecting steam away from the floor surface.

FIGS. 4-5 are schematic views of a steam cleaning apparatus in the form of a steam mop 10 according to a second example of the present disclosure. The steam cleaning apparatus of FIGS. 4 and 5 can be substantially similar to the steam cleaning apparatus of FIGS. 1-3, therefore the discussion is limited to the differences between the two.

Instead of a mechanical valve actuator as shown in FIGS. 2-3, the diverter 60 of the second example includes an accelerometer 100 configured to detect acceleration of the steam mop 10 to determine if the steam mop 10 is moving. The diverter 60 is configured to divert steam away from the floor nozzle 54 when no acceleration of the steam mop 10 is detected by the accelerometer 100, and to deliver steam to the floor nozzle 54 when acceleration of the steam mop 10 is detected by the accelerometer 100. In one example, the accelerometer 100 is particularly configured to detect acceleration relative to the handle 62 to determine if the steam mop 10 is moving.

The accelerometer 100 can be provided on the handle 62, or alternatively, in the base housing 74. The accelerometer 100 can be in the form of any suitable accelerometer, such as a piezoelectric accelerometer or a low impedance output accelerometer. The accelerometer 100 is configured output a signal 102, which can include power, resistance, current, or a voltage signal, for example. In one example, the signal 102 can comprise a pulse width modulated voltage signal. The signal 102 from the accelerometer 100 can be relayed to a control module 108, such as, but not limited to, a microcontroller, which can be used to selectively move the valve plunger 84 of the diverter valve 70 to the open or closed position, depending on the signal emitted by the accelerometer 100. In one example, the control module 108 can be connected to an electrical valve actuator and the accelerometer 100 can be mounted on the control module 108. In another example, the control module 108 can be separate from the accelerometer 100. As such, the control module 108 can be carried by the handle 62 or the cleaning head 66.

The diverter valve 70 of the second example can be electrically actuated, such as by providing an electrical switch 104 between the diverter valve 70 and the power source 38 (FIG. 1) that is selectively activated when acceleration is detected by the accelerometer 100 and the signal 102 is output to the control module 108, thereby powering the diverter valve 70 to move to either the first or second position. For example, when acceleration is detected by the accelerometer 100, the signal 102 from the accelerometer 100 is output to the control module 108, which can open the switch 104 and selectively de-energize the diverter valve 70, and move the valve plunger 84 to the first position for delivering steam to the floor surface. When acceleration is not detected by the accelerometer 100, a signal 102 from the accelerometer 100 is output to the control module 108, which can close the switch 104, and selectively energize the diverter valve 70 and move the valve plunger 84 to the second position for redirecting steam away from the floor surface.

Other configurations for the switch 104 and valve 70 are possible. For example, alternatively, the diverter 60 can be configured such that when acceleration is detected by the accelerometer 100, the signal 102 from the accelerometer 100 is output to the control module 108, which can close the switch 104, and selectively energize the diverter valve 70 and move the valve plunger 84 to the first position for delivering steam to the floor surface. When acceleration is not detected by the accelerometer 100, the signal 102 from the accelerometer 100 is output to the control module 108, which can open the switch 104, and selectively de-energize the diverter valve 70 and move the valve plunger 84 to the second position for redirecting steam away from the floor surface.

In one example, the diverter valve 70 can be a solenoid diverter valve, and the switch 104 can be a micro-switch can be coupled to the handle 62 to selectively energize the solenoid diverter valve 70. The solenoid diverter valve 70 can be selectively activated by the signal 102 from the accelerometer 100 output to the control module 108 to move the valve plunger 84 from the first position to the second position, and vice versa, depending on whether the steam mop 10 is moving.

FIG. 4 shows the diverter valve 70 in the first position for delivering steam to a floor surface. In use, a user can grip the end of the handle 62 and facilitate movement on the surface to be cleaned by pivoting the handle 62 in a downwards direction to a reclined use position. When the handle 62 is in use and moving, such as when the steam mop 10 is moving back and forth across a surface to be cleaned as indicated by the arrow 106, acceleration is detected by the accelerometer 100. A signal 102 from the accelerometer 100 is output to the control module 108 and relayed to the diverter valve 70 and the diverter valve 70 moves to the first position. The steam generator 30 is fluidly coupled with the floor nozzle 54 via the steam distribution path 56, and the valve plunger 84 closes the pathway to the diversion nozzle 64.

FIG. 5 shows the diverter valve 70 in a second position for redirecting steam away from the floor surface. When a user is not moving the handle 62 acceleration is not detected by the accelerometer. Whether the handle 62 is in a parked position, as shown in FIG. 5, or a reclined position, a lack of movement by the steam mop 10 can be detected by the accelerometer 100. A signal 102 from the accelerometer 100 is generated and output to the control module 108. The signal 102 can be generated immediately upon a lack or movement, or alternatively after a lack of movement lasting a predetermined period of time, such as, but not limited to, 5-10 seconds. The signal 102 from the accelerometer 100 is output to the control module 108 and relayed to the diverter valve 70 and the diverter valve 70 moves to the second position. Thus, the steam generator 30 is fluidly coupled with the diversion nozzle 64 via the diversion conduit 76, and the valve plunger 84 closes the pathway to the floor nozzle 54.

The steam cleaning apparatus disclosed herein provides an improved cleaning operation that can prevent inadvertent floor damage. One advantage that may be realized in the practice of some examples of the described steam cleaning apparatus is that steam is diverted away from the floor via a diverter valve 70 when the steam cleaning apparatus is parked and/or is not in use. Therefore, steam will cease saturation of the floor via the at least one steam outlet 54. As a result, over-saturation of steam on the floor can be avoided. Over-saturation of steam on the floor can be damaging to carpet, wood, linoleum, etc. as the high temperature of the steam can melt or deform various compositions.

To the extent not already described, the different features and structures of the various examples can be used in combination with each other as desired. That one feature may not be illustrated in all of the examples is not meant to be construed that it cannot be, but is done for brevity of description. Thus, the various features of the different examples can be mixed and matched as desired to form new examples, whether or not the new examples are expressly described. All combinations or permutations of features described herein are covered by this disclosure.

While the present disclosure has been specifically described in connection with certain specific examples thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the examples disclosed herein are not to be considered as limiting, unless the claims expressly state otherwise.

What is claimed is:

1. A cleaning apparatus, comprising:

a cleaning head movable along a floor surface;

a handle operably coupled with the cleaning head;

a supply tank adapted to hold a quantity of cleaning fluid;

a cleaning fluid outlet in fluid communication with the supply tank and positioned to distribute cleaning fluid to the floor surface, the cleaning fluid outlet provided on the cleaning head;

a distribution path between the supply tank and the cleaning fluid outlet, the distribution path comprising a portion extending through the cleaning head to the cleaning fluid outlet; and an accelerometer configured to detect acceleration of the cleaning apparatus to determine if the cleaning apparatus is moving; and a diverter provided on the cleaning head in the portion of the distribution path extending through the cleaning head to the cleaning fluid outlet, the diverter configured to divert cleaning fluid away from the cleaning fluid outlet when no acceleration of the cleaning apparatus is detected by the accelerometer and configured to deliver cleaning fluid to the cleaning fluid outlet when acceleration of the cleaning apparatus is detected by the accelerometer.

2. The cleaning apparatus of claim 1 wherein the diverter comprises an electrically-actuated diverter valve and a switch operably connected to the electrically-actuated diverter valve, wherein a signal from the accelerometer to a control module opens or closes the switch.

3. The cleaning apparatus of claim 1 wherein the accelerometer is provided on the handle and is configured to detect acceleration relative to the handle to determine if the cleaning apparatus is moving.

4. The cleaning apparatus of claim 1 wherein the diverter comprises a solenoid diverter valve, and wherein a signal from the accelerometer is output to a control module which selectively activates the solenoid diverter valve.

5. The cleaning apparatus of claim 1 wherein the diverter comprises a diverter valve having a valve outlet in fluid communication with the cleaning fluid outlet.

6. The cleaning apparatus of claim 5 comprising a control module, wherein a signal from the accelerometer is output to the control module to selectively power the diverter valve.

7. The cleaning apparatus of claim 6, wherein the accelerometer is mounted on the control module.

8. The cleaning apparatus of claim 1 comprising a steam generator in fluid communication with the supply tank and configured to heat cleaning fluid to generate steam, wherein the generated steam is supplied to the cleaning fluid outlet via the distribution path, and wherein the cleaning fluid outlet comprises a steam outlet to distribute the generated steam to the floor surface, and the distribution path comprises a portion extending between the supply tank and the steam generator and a portion extending between the steam generator and the steam outlet.

9. The cleaning apparatus of claim 8 wherein the diverter comprises a diverter valve having an inlet in fluid communication with the steam generator and a first outlet in fluid communication with the steam outlet.

10. The cleaning apparatus of claim 9 wherein the diverter valve has a second outlet in fluid communication with a steam exhaust port spaced from the steam outlet.

11. The cleaning apparatus of claim 10, comprising a first conduit fluidly coupling the first outlet with the steam outlet and a second conduit fluidly coupling the second outlet with the steam exhaust port.

12. The cleaning apparatus of claim 10 wherein the diverter valve comprises a valve plunger moveable to close one of the first outlet and the second outlet.

13. The cleaning apparatus of claim 12 comprising an electrical valve actuator provided to engage the valve plunger to control a position of the valve plunger.

14. The cleaning apparatus of claim 12 wherein the diverter valve comprises a spring biasing the valve plunger to a position in which the portion of the distribution path extending between the steam generator and the steam outlet is open.

15. The cleaning apparatus of claim 12 wherein the diverter valve comprises a valve housing having the inlet and the first outlet, and wherein the valve plunger includes at least a portion moveably received within the valve housing to selectively seal the first outlet.

16. The cleaning apparatus of claim 1, comprising a coupling joint pivotally mounting the handle with the cleaning head for movement about an axis.

17. The cleaning apparatus of claim 1, comprising a diversion nozzle in fluid communication with the diverter and positioned to direct cleaning fluid away from the floor surface, wherein the diverter is configured to deliver cleaning fluid to the diversion nozzle when no acceleration of the cleaning apparatus is detected by the accelerometer.

18. The cleaning apparatus of claim 1, comprising an upright assembly pivotally coupled with the cleaning head for movement about at least one axis, wherein the upright assembly comprises the handle.

19. A cleaning apparatus, comprising:

a cleaning head movable along a floor surface;

a supply tank adapted to hold a quantity of cleaning fluid;

a cleaning fluid outlet in fluid communication with the supply tank and positioned to distribute cleaning fluid to the floor surface, the cleaning fluid outlet provided on the cleaning head;

a distribution path between the supply tank and the cleaning fluid outlet, the distribution path comprising a portion extending through the cleaning head to the cleaning fluid outlet; and a diverter provided on the cleaning head in the portion of the distribution path extending through the cleaning head to the cleaning fluid outlet, the diverter configured to divert cleaning fluid away from the cleaning fluid outlet when the cleaning head is stationary and configured to deliver cleaning fluid to the cleaning fluid outlet when the cleaning head is moving.

20. The cleaning apparatus of claim 19, comprising an accelerometer configured to detect acceleration of the cleaning apparatus to determine if the cleaning head is moving, wherein the diverter is configured to divert cleaning fluid away from the cleaning fluid outlet when no acceleration of the cleaning apparatus is detected by the accelerometer and configured to deliver cleaning fluid to the cleaning fluid outlet when acceleration of the cleaning apparatus is detected by the accelerometer.

* * * * *